US005376436A

United States Patent [19]

Mpandou et al.

[11] Patent Number: 5,376,436

[45] Date of Patent: Dec. 27, 1994

[54] MATERIALS FOR RECORDING USING HEAT TRANSFER, CAPABLE OF BEING USED SEVERAL TIMES

[75] Inventors: André Mpandou, Martin-Eglise; Bruno Launay, Tóte, both of France

[73] Assignee: Regma, Nanterre, France

[21] Appl. No.: 389,793

[22] Filed: Aug. 4, 1989

[30] Foreign Application Priority Data

Aug. 4, 1988 [FR] France ..... 88 10776

[51] Int. Cl.[5] ..... B41M 5/20

[52] U.S. Cl. ..... 428/212; 428/195; 428/207; 428/474.4; 428/484; 428/488.1; 428/488.4; 428/913; 428/914

[58] Field of Search ..... 428/195, 913, 914, 474.4, 428/484, 488.1, 488.4, 207, 212

[56] References Cited

U.S. PATENT DOCUMENTS

| | | | |
|---|---|---|---|
| 3,410,203 | 8/1967 | Kischbeck | 346/76 L |
| 4,123,580 | 10/1978 | Franer | 428/304 |
| 4,489,122 | 4/1984 | Kammin et al. | 428/212 |
| 4,880,324 | 11/1989 | Sato et al. | 428/488.1 |
| 4,937,163 | 9/1990 | Tam et al. | 430/41 |
| 5,104,721 | 2/1992 | Sun | 428/206 |
| 5,138,388 | 12/1992 | Kamp et al. | 355/251 |

FOREIGN PATENT DOCUMENTS

| | | | |
|---|---|---|---|
| 0076044 | 4/1983 | European Pat. Off. | 428/195 |
| 0152795 | 8/1985 | European Pat. Off. | 428/195 |
| 0191498 | 8/1986 | European Pat. Off. | 428/195 |
| 0214770 | 3/1987 | European Pat. Off. | 428/195 |
| 0238242 | 9/1987 | European Pat. Off. | 428/195 |
| 2010515 | 6/1979 | United Kingdom | 428/195 |
| WO05197 | 9/1986 | WIPO | 428/195 |
| 92/09936 | 4/1992 | WIPO . | |

*Primary Examiner*—Pamela R. Schwartz
*Attorney, Agent, or Firm*—Breiner & Breiner

[57] ABSTRACT

The material comprises a base carrier coated with at least one layer of a thermofusible ink which has a melting temperature within the range from 50° to 90° C. and comprises at least one coloring substance and a thermofusible vehicle for this coloring substance, characterized in that the ink comprises from 15 to 50%, relative to the weight of the ink, of at least one heat transfer polymer resin mixed homogeneously with the other constituents of the ink, having a softening point of between 60° and 113° C., a tensile strength lower than 8 $N/mm^2$ at 20° C., an elongation of between 0.04 and 6 mm, a melt viscosity lower than 5 Pas at 200° C., and an adhesiveness to the base carrier such that, at the heat transfer temperature, the force needed to separate the ink from the said carrier is greater than the force needed to break the internal cohesion of the ink.

8 Claims, No Drawings

MATERIALS FOR RECORDING USING HEAT TRANSFER, CAPABLE OF BEING USED SEVERAL TIMES

The present invention relates to new materials for recording using heat transfer, such as sheets, films or tapes, which can be used a number of times.

The process of recording data, whatever their nature, using heat transfer is widely employed because of the numerous advantages which it offers (in particular simplicity and low cost of the apparatus employed, and stability of the recordings). Nevertheless, users of this process consider that its running cost can be reduced by reusing the recording materials (sheets, films, tapes) several times in succession. In fact, when thermal recording materials of the usual type comprising an ordinary thermofusible ink, all the ink carried by a small part of the carrier of the material is transferred from the said material onto the receiving material. It therefore becomes impossible to reuse the recording material a second time for a new recording operation and to use all the ink still carried by the carrier after a first heat transfer, if a uniform optical density of the information transferred is to be retained. This single use of the recording material increases the running cost of recording using heat transfer and does not enable the autonomy of the tape cassettes or the like to be improved. Attempts have therefore been made to overcome these disadvantages by developing recording materials ensuring a progressive heat transfer of the thermofusible ink. Various solutions have been proposed for this purpose. Thus, heat transfer materials have been described, in which the thermofusible ink impregnates a porous structure which is continuous or in the form of porous particles, cf: Japanese Patent Application No. 54/68253; French Patent Application No. 85/09729, published under No. 2,566,328. Heat transfer materials have also been described, in which the layer of thermofusible ink contains fine organic particles (phenolic resins, epoxy resins) or inorganic particles (metal oxides, metal powders, molecular sieves, diatomaceous earth), porous or otherwise, forming a barrier layer slowing down the transfer of the thermofusible ink.

It has also been proposed to slow down the transfer of the thermofusible ink from its carrier towards the material intended to receive the recording, by placing a layer of an adhesive compound between the recording material and the ink layer, cf. for example: published Japanese Applications Nos. 60/54,893, 60/255,490, 60/54,894 and 61/255,895. Despite the advantage which they offer, these various techniques have the disadvantage of complicating the manufacture of the recording materials, with the result that industry is continuing to search for a simple means enabling a heat transfer ink to be delivered gradually from a carrier so that the recording material may be reused a number of times, resulting, each time it is used, in a recording exhibiting a good optical density. The present invention relates precisely to a new solution to the problem of reusable heat transfer materials referred to hereinafter, for convenience, as multipass recording materials.

A first objective of the present invention lies in developing multipass recording materials which are simple to produce.

A second objective of the present invention lies in increasing the number of possible reuses of the multipass recording material.

A third objective of the present invention lies in improving the optical density of the recordings resulting from the use of the multipass recording materials.

More specifically, the subject of the present invention is a material for recording using multipass heat transfer, comprising a base carrier coated with at least one layer of a thermofusible ink which has a melting temperature within the range from 50° to 90° C. and comprises at least one colouring substance and a thermofusible vehicle for this colouring substance, characterized in that the ink comprises from 15 to 50%, relative to the weight of the ink, of at least one heat transfer polymer resin, mixed homogeneously with the other constituents of the ink, having a softening point of between 60° and 130° C., a tensile strength lower than 8 $N/mm^2$ at 20° C., an elongation of between 0.04 and 6 m/m, a melt viscosity lower than 5 Pa s at 200° C., and an adhesiveness to the base carrier such that, at the heat transfer temperature, the force needed to separate the ink from the said carrier is greater than the force needed to break the internal cohesion of the ink.

In what follows and for convenience, the heat transfer polymer resin ensuring the gradual transfer of the ink will be referred to by the expression "transfer resin".

The ink for multipass heat transfer, which has been developed contains, like the usual inks of single-pass heat from the transfer materials, at least one colouring substance from the chromatic colours such as blue, red and yellow, or at least one black colouring substance and a thermofusible vehicle for the said substance, that is to say a compound or a mixture of compounds compatible with the colorants and melting at a temperature of between 50° and 150° C. These single-pass inks generally have a degree of transfer higher than 80%. In the present application, the degree of transfer is defined by the ratio of the quantity of ink transferred from the heat transfer material onto the receiving material to the quantity of ink present on the transfer material before the latter transfer, expressed as a percentage.

To obtain a multipass material, an ink with a degree of transfer of between 5 and 60% has been developed. For this purpose, the ink must fulfill the following conditions:

- have a very good adhesiveness to the base carrier (for example polyester film),
- have a very good fusibility (melting temperature of between 50° and 90° C.),
- have an internal cohesive strength of the ink at the time of transfer (during the separation of the recording material from the receiver carrier) which is sufficiently low to permit a rupture within the ink layer and not at the interface with the base carrier.

The colouring substances which are suitable for the preparation of the ink of heat transfer materials in accordance with the invention are those usually employed. Colouring substances means organo- or water-soluble colorants or pigments. They may be inorganic or organic, of natural or synthetic origin. Thus, use may be made of dyes such as those described in DE-A-3520 308, EP-A0,063,000 and DE-A-3606,710. Among the black colorants, there may be specifically mentioned: carbon black, the colorants sold under the trademarks: NOIR CERES by Bayer, NOIR NEOPRENE by BASF, NOIR AU GRAS by Ciba-Geigy, magnetic iron oxide such as those sold under the trademark BAYFERROX by Bayer. In the case of the black colorants, it has been found that the combination of one or more organic colorants with magnetic iron oxide results in excellent optical densities of the recording resulting from the heat transfer and in a good retention of the printing. The quality of the latter is very particularly suitable for the recognition of the characters by optical or magnetic reading.

One or more organic compounds melting between 50° and 150° C., such as those usually employed in inks for heat transfer, are used as a vehicle for the colouring substances. These may be natural or synthetic products. For this purpose, there may be mentioned, no limitation being implied: vegetable waxes such as carnauba wax, candelilla wax, animal waxes such as lanolin, beeswax, mineral waxes such as montan waxes, synthetic waxes such as paraffin wax, microcrystalline waxes, long chain, their esters and their amides, such as: stearic acid, palmitic acid, stearamide, palmitamide; alkali metal salts of fatty acids, polyols such as polyethylene glycol; sorbitol, polypropylene glycol, polyol ethers such as polyethylene glycol; and lanolin ethers; long chain alcohols (palmityl, stearyl and cetyl alcohols); polymers such as polyvinyl esters (polyvinyl acetate), and ethylene/vinyl acetate copolymers.

The transfer resin or the mixture of transfer resins is the key ingredient of the inks which can be used in the multipass recording materials of the invention and must have the following properties:

- a good adhesiveness to the base carrier,
- a melting temperature of between 60° and 130° C., preferably between 70° and 100° C.,
- a tensile strength of less than 8 N/mm$^2$ at 20° C., according to DIN standard 53455,
- a melt viscosity lower than 5 Pa s at 200° C.

The transfer resin (or the mixture of transfer resins) is chosen so as to ensure a degree of transfer of the ink of between 5% and 60% on each of the first ten uses (or passes) of the heat transfer carrier. Without any limitation being implied, there may be mentioned polyamide resins such as those sold under the trademarks EURELON by Schering, terpene resins such as those sold under the trademark DERTOLENE-DERTOPHENE or DERTENATE by DRT or rosins such as those sold under the trademark STAYBELITE by Hercules.

The most suitable transfer resin in the invention is an adhesive polyamide resin of a flexible type, which has the following characteristics:

- softening point of approximately 95° C. (DIN standard 52011),
- melting temperature of approximately 73° C. (measured on a differential thermal analysis curve obtained with the Mettler FP800 thermal system, FP81 cell),
- melt viscosity of 1 to 1.5 Pa s at 160° C.,
- tensile strength of approximately 3.5 N/mm$^2$ at 20° C.,
- elongation of approximately 0.7 m/m at 20° C. (DIN standard 53455).

A resin of this kind is sold under the trademark EURELON-2095 by Schering.

The quantity of polymer resin used to ensure a gradual transfer of the ink at each pass depends on the nature of the carrier and of the latter's composition. In general, this quantity represents from 15 to 50% by weight and preferably from 20 to 40% of the total of the transferable composition.

Two or more transfer resins may be used in combination without departing from the scope of the present invention.

The carrier for the ink layer which is employed is one of those usually employed. These may be films, sheets or tapes made of film-forming polymers such as linear polyesters and, especially, polydiol (for example ethylene glycol) terephthalates), polyamides (polyhexamethylene adipamide, polycaprolactam), polyethylene, polypropylene, polycarbonates, cellulose derivatives (cellulose esters, paper). Polyterephthalates are very particularly suitable. The back face of the carrier, that is to say the face opposite to that carrying the ink, may be provided with the usual coatings intended to ensure that they have a good heat resistance and/or good machinability and/or antistatic properties. Back coatings of polysiloxanes or of polyurethanes may be mentioned for this purpose.

The thickness of the ink layer containing the polymer resin is determined so as to ensure a sufficient optical density for recording after at least six passes of the heat transfer carrier. In general it is between 4 and 35 μm and preferably between 4 and 20 μm. It is possible, without departing from the scope of the present invention, to place on the ink layer in accordance with the invention an ink layer containing less than 5% by weight of transfer resin and, preferably, not containing any of it that is to say a layer of an ink more than 80% of which is transferred on the first pass. To promote the rupture within the thermofusible assembly, the melt viscosity of the second layer of ink must be lower than that of the first layer containing the transfer resin, and its melting point must not exceed that of the first ink layer. This layer may have a thickness of between 2 μm and 10 μm. In addition to the transfer resin, the ink of the recording materials in accordance with the invention may comprise other polymer resins used in single-pass or multipass inks, such as, for example, polyvinyl acetates, ethylene/vinyl acetate (EVAC) copolymers and the usual additives (for example plasticizers).

The multipass materials in accordance with the present invention may be obtained by the usual processes for coating carriers made of film-forming polymer, either using a solution of the ink composition in one or more organic solvents: ketones (methyl ethyl ketone), aliphatic hydrocarbons (hexane), cycloaliphatic or aromatic hydrocarbons (toluene), alcohols (propanol, isopropanol) or, preferably, using a molten composition.

The inks in solution are obtained by dissolving the soluble substances in the chosen solvent(s) and then, if appropriate, dispersing insoluble substances (for example pigments) using a turbine or a ball mill.

The molten inks are prepared by melting the fusible ingredients by heating to between 80° and 180° C., followed by addition of the colouring substance(s) with stirring with the aid of a turbine or a ball mill.

The following examples, in which no limitation is implied, illustrate the invention and show how it can be put into practice.

In these examples the optical density was measured by reflection on transferred flat tints, with the aid of a MACBETH TR-927 trademark densitometer.

EXAMPLES 1 to 11

In the following examples, tapes were prepared by coating a 6-μm thick polyethylene terephthalate film comprising a back coating based on a polysiloxane resin. Coating of the carrier was carried out using a melt or a solution, depending on the ink composition. The adhesiveness, fusibility and low internal cohesion conditions necessary for multipass and not for single-pass operation were optimized by adding to the transfer resin additional products such as natural or synthetic waxes, paraffin waxes, fatty acids or other materials of low melting point which are well known in conventional single-pass inks. In particular, those mentioned in Table 1 below.

Inks A to K, whose composition in percentages by weight is shown in Table I below, were deposited onto the carrier by the melt process in the case of ink A and in solution form in the case of inks B to K. In this last case, the coated carriers were dried in a drier between 50° and 150° C. Eleven films coated with a 14-μm ink layer were obtained and were converted into heat transfer tapes.

The tapes thus obtained were subjected to transfer tests. For this purpose, the same text was reproduced six consecutive times with each tape sample and the density of the text reproduced was then measured after each pass. The transfer was carried out onto a 50-second glazing receiver paper measured on a BEKK-31 E apparatus, under the transfer conditions applied to the single-pass tapes (temperature of between 60° and 70° C.). The results are shown in Table II.

TABLE 1

| CONSTITUENTS | INKS A | B | C | D | E | F | G | H | I | J | K |
|---|---|---|---|---|---|---|---|---|---|---|---|
| PARAFFIN WAX % | 14.34 | 30 | 12 | 29.93 | 21 | 24 | 12 | 30 | 30 | 19 | 30 |
| CARNAUBA WAX % | 17.76 | — | 4 | — | — | — | 4 | — | — | — | — |
| STEARIC ACID % | 5.78 | — | 4 | — | 6 | 6 | 4 | — | — | 4 | — |
| EVAC RESIN % | — | 4 | 4 | 4.27 | 9 | 8 | 4 | 4 | 4 | 7 | 4 |
| POLYAMIDE RESIN % (EURELON-2095) | 20.22 | 20 | 27 | 20.50 | 28 | 27 | 27 | 20 | 20 | 26 | 20 |
| ROSIN (staybelite resin) % | — | — | 10 | — | — | 10 | — | — | 7 | — | 7 |
| TERPENE RESIN % | 4.60 | 7 | — | 6.84 | 10 | — | 10 | 7 | — | 10 | — |
| CARBON BLACK % | 5.78 | — | — | — | 12 | 12 | — | — | — | 20 | 26 |
| MAGNETIC IRON OXIDE % | 31.52 | 26 | 29 | 25.64 | — | — | 29 | 26 | 26 | — | — |
| NOIR CERES % | — | 5 | — | 12.82 | — | — | 8.50 | — | — | 14 | 13 |
| NOIR AU GRAS % | — | — | 8.50 | — | 14 | 13 | — | — | — | — | — |
| NOIR NEOPRENE X 53% | — | 8 | — | — | — | — | — | 13 | — | — | — |
| NOIR NEOPRENE X 58% | — | — | — | — | — | — | — | — | 13 | — | — |
| SUCROSE ACETOISO-BUTYRATE % | — | — | 1.50 | — | — | — | 1.50 | — | — | — | — |

TABLE II

| EXAMPLES | INKS | OPTICAL DENSITIES NUMBER OF PASSES 1 | 2 | 3 | 4 | 5 | 6 |
|---|---|---|---|---|---|---|---|
| 1 | A | 0.85 | 0.90 | 0.88 | 0.80 | 0.80 | 0.78 |
| 2 | B | 1.35 | 1.10 | 0.90 | 0.80 | 0.75 | 0.70 |
| 3 | C | 1.24 | 0.92 | 0.85 | 0.80 | 0.74 | 0.69 |
| 4 | D | 1.42 | 1.23 | 0.94 | 0.89 | 0.77 | 0.71 |
| 5 | E | 1.30 | 1.05 | 0.86 | 0.82 | 0.74 | 0.68 |
| 6 | F | 1.33 | 1.15 | 1.01 | 0.88 | 0.81 | 0.78 |
| 7 | G | 1.28 | 0.90 | 0.85 | 0.76 | 0.70 | 0.70 |
| 8 | H | 1.17 | 0.85 | 0.75 | 0.70 | 0.69 | 0.65 |
| 9 | I | 0.99 | 0.76 | 0.71 | 0.68 | 0.66 | 0.64 |
| 10 | J | 1.35 | 1.18 | 0.98 | 0.76 | 0.68 | 0.65 |
| 11 | K | 1.22 | 1.08 | 0.89 | 0.82 | 0.79 | 0.75 |

By way of comparison, an ink A' containing the same constituents as the ink A, with the exception of the polyamide and terpene resins, was prepared. This ink has the following composition by weight:

| | |
|---|---|
| stearic acid | 7.7% |
| paraffin wax | 19.1% |
| carnauba wax | 23.6% |

-continued

| | |
|---|---|
| magnetic iron oxide | 41.9% |
| carbon black | 7.7% |

The tapes obtained with the aid of this ink (14-μm layer thickness) produced the following optical densities after each of the six passes on a heat transfer machine.

| passes No.: | 1 | 2 | 3 | 4 | 5 | 6 |
|---|---|---|---|---|---|---|
| optical densities: | 1.42 | 0.36 | 0.19 | 0.12 | 0.12 | 0.07 |

EXAMPLE 12

A heat transfer tape was prepared, comprising two layers:

a 9-μm layer of ink A a 5-μm thick layer of ink containing no transfer resin and whose composition by weight is the following:

| | |
|---|---|
| stearic acid | 8% |
| EVAC | 9% |
| paraffin wax | 38% |
| magnetic iron oxide | 26% |
| NOIR CERES | 19% |

The first layer was deposited as a melt and the second in solution.

The optical densities measured after each of the six passes of the same sample of tape in a heat transfer machine are the following:

| passes No.: | 1 | 2 | 3 | 4 | 5 | 6 |
|---|---|---|---|---|---|---|
| optical densities: | 1.28 | 1.1 | 1.02 | 0.9 | 0.8 | 0.7 |

What is claimed is:

1. Multipass heat transfer recording material comprising a base carrier coated with at least one layer of a thermofusible ink which has a melting temperature within the range of from 50° to 90° C., and from 15 to 50%, relative to the weight of the ink, of at least one heat transfer polymer resin mixed homogeneously with the other constituents of the ink, wherein said resin has a softening point of between 60° and 130° C., a tensile strength lower than 8 N/mm$^2$ at 20° C., an elongation of between 0.04 and 6 m/m, a melt viscosity lower than 5 Pa.s at 200° C., an adhesiveness to the base carrier such that, at the heat transfer temperature, the force needed to separate the ink from said carrier is greater than the force needed to break the internal cohesion of the ink, thereby providing a degree of transfer to said ink of between 5% and 60% at each pass of said recording material.

2. Recording material according to claim 1 wherein said heat transfer polymer resin is present in an amount of from 20 to 40% by weight.

3. Recording material according to claim 1 or 2 wherein said transfer resin comprises a terpene resin.

4. Recording material according to claim 1 or 2 wherein said transfer resin is a mixture of a polyamide resin and a terpene resin.

5. Recording material according to claim 1 wherein said transfer resin comprises a polyamide resin.

6. Recording material according to claim 5 wherein said polyamide resin has a softening point of approximately 95° C., a melting temperature of approximately 73° C., a melt viscosity of 1–1.5 Pa.s at 160° C., a tensile strength of approximately 3.5 $N/mm^2$ at 20° C. and an elongation of approximately 0.7 m/m at 20° C.

7. Recording material according to claim 1 wherein the thickness of said ink layer is from 4 to 35 $\mu$m.

8. Recording material according to claim 1 which further comprises a second layer of ink free from transfer resin, the melt viscosity of said second layer of ink being lower than that of the ink of the first layer and the melting temperature of said second layer of ink not exceeding that of the first layer.

* * * * *